US005209144A

United States Patent [19]

Lu Guoji

[11] Patent Number: 5,209,144

[45] Date of Patent: May 11, 1993

[54] DUAL-PURPOSE QUICKLY ADJUSTABLE WRENCH

[76] Inventor: Lu Guoji, Rm. 1401, Building No. 12, Anwaianhuilisanqu, Beijing, China 100012, P.R.C.

[21] Appl. No.: 869,295

[22] Filed: Apr. 16, 1992

[30] Foreign Application Priority Data

Apr. 19, 1991 [CN] China ..... 91206144.8

[51] Int. Cl.[5] ..... B25B 13/14

[52] U.S. Cl. ..... 81/165; 81/178; 81/135

[58] Field of Search ..... 81/133–135, 81/142, 145, 167–169, 170, 178, 185.1, 186, 421–423

[56] References Cited

U.S. PATENT DOCUMENTS

| | | | |
|---|---|---|---|
| 159,420 | 2/1875 | Kohler | 81/178 X |
| 953,346 | 3/1910 | Newbauer | 81/178 X |
| 1,228,850 | 6/1917 | Upson | 81/165 X |
| 1,402,686 | 1/1922 | Trabold | 81/165 X |
| 1,551,763 | 9/1925 | Morns | 81/165 X |
| 1,557,864 | 10/1925 | Mull | 81/165 X |
| 2,499,609 | 3/1950 | Klordan | 81/135 |
| 2,724,301 | 11/1955 | Parent et al. | 81/165 |

FOREIGN PATENT DOCUMENTS

| | | |
|---|---|---|
| 88221054.8 | 12/1988 | China . |
| 89217429.3 | 9/1989 | China . |

*Primary Examiner*—D. S. Meislin

*Attorney, Agent, or Firm*—Roylance, Abrams, Berdo & Goodman

[57] ABSTRACT

A dual-purpose adjustable wrench is comprised of a wrench body, a movable jaw unit and a worm gear rack mechanism for providing a rapid adjustment of the wrench. The wrench is further comprised of a clutch unit to enable the jaw opening to be quickly adjusted. The movable unit comprises a toothed element hinged at one of lateral sides of the movable jaw. The wrench can be alternated to function as a pipe wrench by removing the movable jaw unit, reversing and inserting it back into the wrench body.

1 Claim, 7 Drawing Sheets

DUAL-PURPOSE QUICKLY ADJUSTABLE WRENCH

BACKGROUND OF THE INVENTION

The present invention relates to hand tools particularly to an adjustable wrench adapted to set and loose. The jaw unit thread connection assembly, which comprises a worm gear rack mechanism with a clutch unit, and a movable jaw unit which has a smooth lateral side and a toothed lateral side which can be removed from the wrench body, turned over and then inserted back, thereby alternating the functions of the wrench as a normal wrench or as a pipe wrench which is to set or loosen a pipe thread connection.

It is well known that the opening of a prior adjustable wrench is adjusted by means of worm gear rack mechanism. A quickly adjustable wrench has been disclosed, in which the quick adjustment is obtained by pushing the worm away from the engagement with the gear rack of the movable jaw. However, the above adjustable wrench has been found to have poor reliability, firmness and mechanical strength resulting from unsteady position of the worm in the worm gear rack mechanism. Moreover, the prior wrench has another disadvantage that it is only adapted to effectively function either as a normal adjustable wrench to deal with a bolt connection or as a pipe wrench to deal with pipe thread connection and is not able to effectively deal with above two connections at the same time.

Accordingly, the object of the invention is to provide a dual-purpose quickly adjustable wrench with perfect reliability, firmness and mechanical strength. The opening of the wrench can be quickly adjusted and the functions of the wrench can be alternated conveniently by means of a clutch unit to control the worm gear rack mechanism, a shaft of the worm fixed when the worm is in the position of engagement, and a movable jaw unit which has a smooth lateral side and a toothed lateral side.

SUMMARY OF THE INVENTION

According to a first aspect of the invention, a dual-purpose quickly adjustable wrench comprises a wrench body, a movable jaw unit and a worm gear rack mechanism as an engagement means of the gear rack formed at the lower side of the movable jaw with the worm mounted in a rectangular hole at the head of the wrench body. The invention further comprises a clutch unit. The movable jaw unit includes a movable jaw with a smooth lateral side, and a toothed element with a toothed lateral side. The toothed element is hinged at the positioning groove of the movable jaw by a biased pin at the front or lower position of the opposed toothed side of the toothed element, thereby providing the movable jaw unit with a toothed lateral side. A spring is provided in a blind hole which is formed in the lateral side of the movable jaw opposing the smooth side thereof to push the toothed element to joint this side closely in such a manner that its toothed side is inclined. When the wrench functions as a pipe wrench, a force acting on the toothed side of toothed element along the longitudinal direction of the surface thereof drives the toothed element to rotate around the pin in such a manner that it compressed the spring to clamp a workpiece and the angle of rotation is dependent on the positioning groove. The side of the positioning groove obstructs the further rotation of the toothed element after a certain rotating angle. The alternate function of the wrench as a normal adjustable wrench can be obtained by releasing the engagement of the worm and gear rack, removing the movable jaw unit, turning over and inserting it back.

A rectangular hole is provided having the head of the wrench body, at one of the long sides of pivotally supporting a clutch unit and in the two short side of which two recesses are respectively formed to cooperate with the ends of the shaft of the worm. The clutch unit comprises a holder with the worm, the shaft of the worm mounted in the recess, and a push plate. When the ends of the shaft are mounted steadily in the recesses, the worm engages with the gear rack formed at the lower side of the movable jaw and the normal adjustment can be carried out by means of rotating the worm. The engagement of worm and gear rack can be released by pushing down the push plate to rotate the holder away from the gear rack so that the movable jaw unit is able to freely slide, whereby a quick adjustment of the opening is carried out and also the alternative function of the wrench can be obtained by removing the movable jaw unit from the sliding slot, turning it over and inserting it back.

According to a second aspect of the invention, the clutch unit comprises a holder with the worm, a shaft of the worm mounted on the holder, a pull plate integrated with the holder and a supporting spring provided between the pull plate and a long side of the rectangular hole and extend therealong. The two ends of the shaft of the worm are put in the grooves. The holder with the worm is raised under the force of the supporting spring to a front position where the worm engages with the gear rack of the movable jaw, whereby the normal adjustment of the wrench opening is carried out.

By drawing the pull plate backward, the holder with the worm moves backward simultaneously while the spring is compressed, so that the engagement of the worm and the gear rack is released, whereby the movable jaw unit can so freely slide along the sliding slot that it can be moved conveniently to quickly adjust the opening of the wrench and also that it can be removed from the sliding slot, turned over, and inserted back to carry out the alternate function of the wrench.

The further objects and features of the invention will appear from following description of the embodiments taken together with the accompanying drawings.

DETAILED DESCRIPTION OF THE PREFERRED EMBODIMENTS

Figure 1:
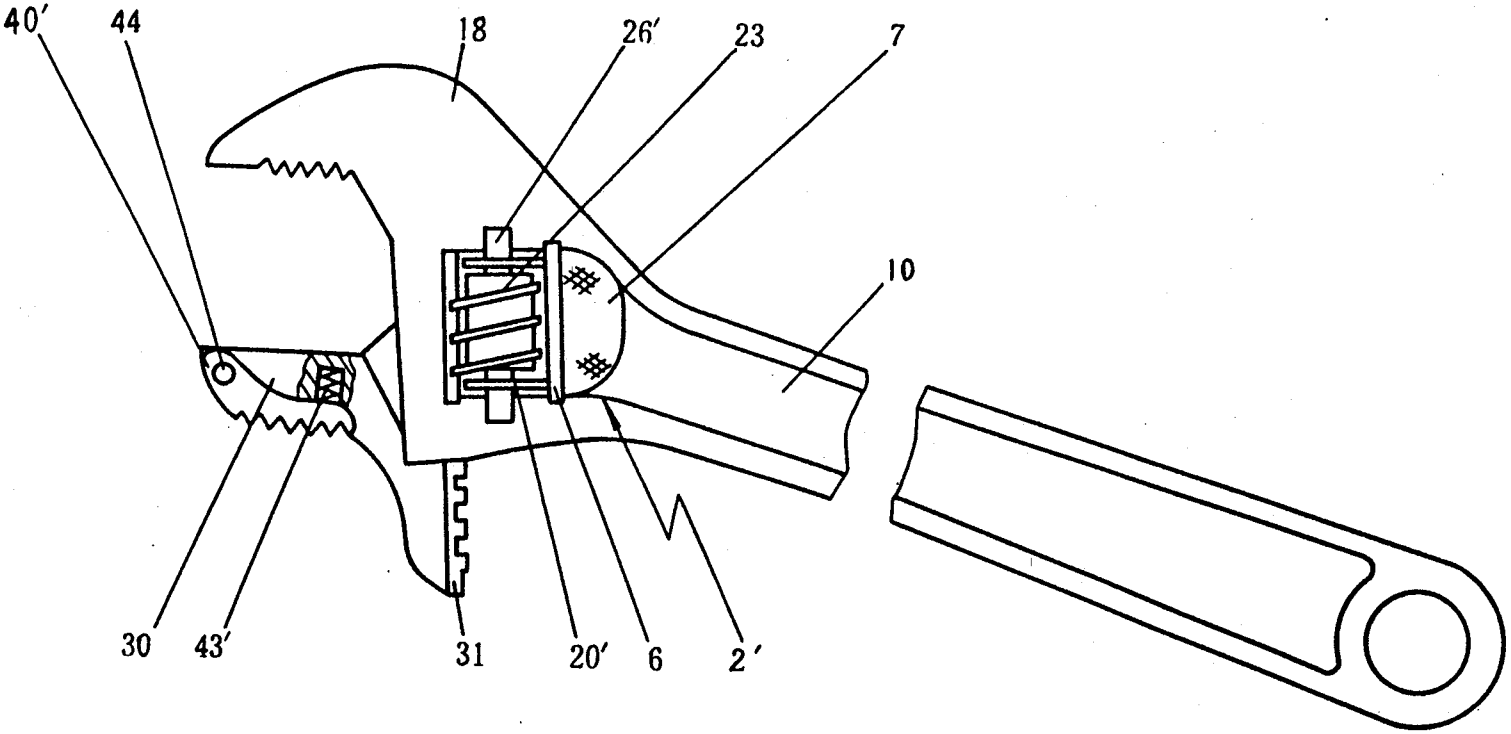
FIG. 1 is a view of the structure of the dual-purpose quickly adjustable wrench according to the first embodiment of the invention, in which the supporting spring is only schematically shown.

Reference is first made to FIG. 1. A dual-purpose quickly adjustable wrench according to the invention comprises a wrench body 1, a movable jaw unit and a clutch unit 3. A fixed jaw 4 is formed in the front of the wrench body 1, and has a toothed middle segment and a smooth outer segment. The movable jaw unit is mounted movably in the sliding slot provided in the head of the wrench body 1. There is a rectangular hole at the head of the wrench body 1, at one of long side of which pivots the clutch unit 3 and at the two short side walls of which respectively form two recesses to fit with the two ends of a shaft 9. The sectional configuration of the recess hole is rectangular. The clutch unit 3 includes a holder 5 with a worm 8, a pivot 6 mounted at one of the long side of the rectangular hole, and a push plate 7. When the push plate 5 is pushed down, the holder 5 and the worm 8 can turn around the pivot 6. The pivot 6 has two rectangular ends which can be laterally inserted and steadily mounted in, and dislocated from the recesses. The movable jaw unit comprises a movable jaw 2 with a smooth lateral side to form that of the movable jaw unit, and a toothed element 11 with a toothed lateral side. The movable jaw 2 has a normal gear rack 10 at the lower side to separably engage with the worm 8. The toothed element 11 is supported by a supporting spring 12 (for example, a supporting spring seats at a blind hole formed in the movable jaw 2. FIG. 1 does not show further detailed structure thereof), and hinged by a pin 15, which is in an offset position of the toothed element, to provide the movable jaw unit with a toothed lateral side. The movable jaw unit can be removed from the sliding slot, turned over and inserted back to alternate the function of the wrench.

Figure 2:
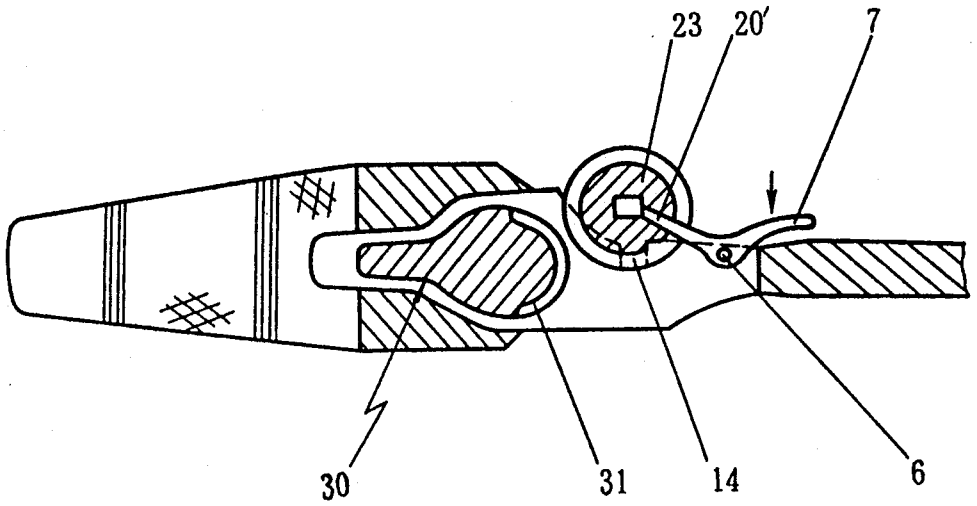
FIG. 2 is a partial schematic side view of the head of the wrench according to the first embodiment of the invention, in which the worm is in the position of disengagement and the shaft of worm, the push plate and the holder are not sectioned for the sake of clarity.

As shown in FIG. 2 when the push plate 7 is pushed down, the holder 5 is swung and the engagement between the worm 8 and the gear rack 10 of the movable jaw 2 is released, whereby the wrench opening can be adjusted by means of the free shift of the position of the jaw 2 along the sliding slot, and also the alternate function of the wrench may be obtained by removing the movable jaw unit from the sliding slot, reversing and inserting it back.

Figure 3:
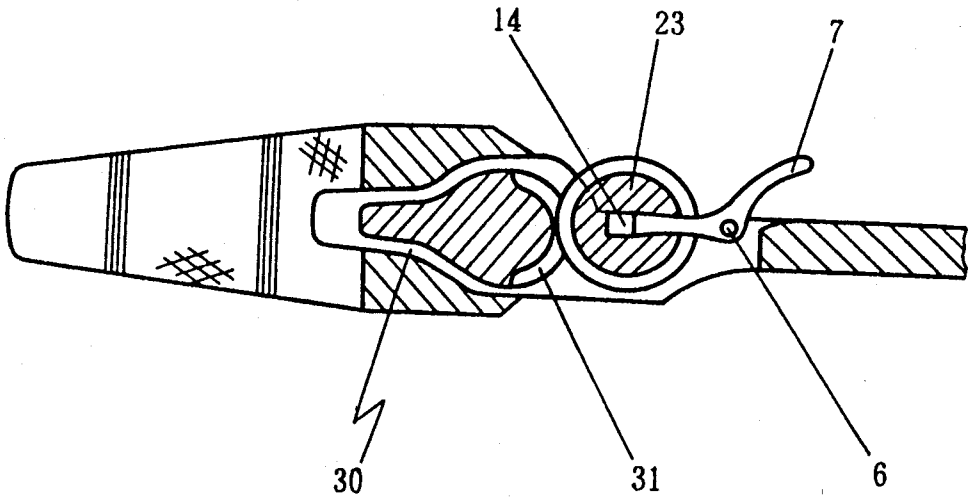
FIG. 3 is a partial schematic side view of the head of the wrench according to the invention, in which the worm is in the position of engagement and, the shaft of worm, the push plate and the holder is not sectioned.

As shown in FIG. 3, when the push plate is not pushed down, the worm 8 engages with the gear rack 10 of the movable jaw 2, whereby the normal adjustment of the wrench opening can be carried out by rotating the worm 8. At this position the two rectangular ends of the shaft 9 is laterally inserted in the recesses in the short side of the rectangular hole and confined therein to position the worm 8.

Figure 4:
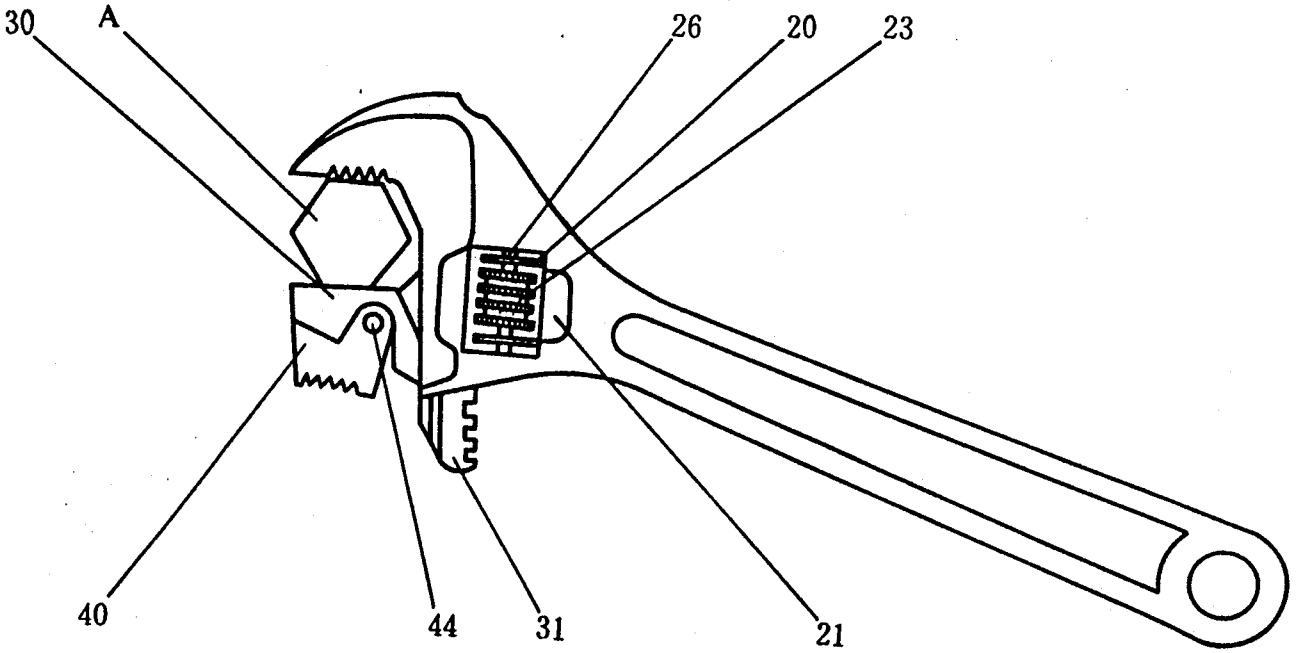
FIG. 4 and FIG. 5 respectively show the alternative functions of the wrench according to the invention.
Figure 5:
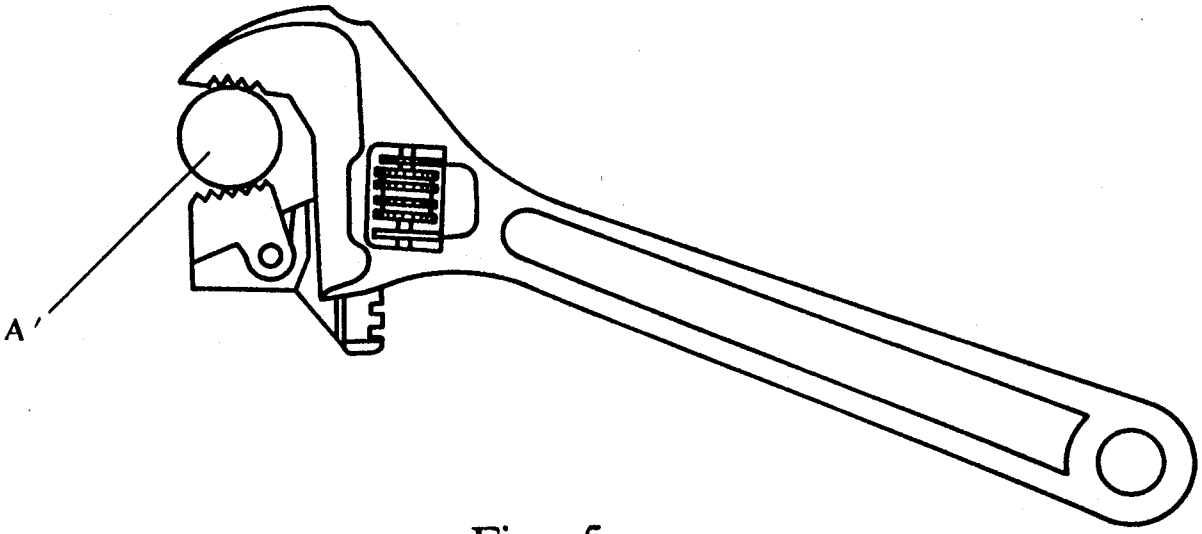

The wrench can function as a normal adjustable wrench with the smooth lateral side of movable jaw unit facing the interior side of the fixed jaw 4, and as a pipe wrench with the toothed side of the toothed element 11 facing the fixed jaw 4. As shown in FIGS. 4 and 5, the middle segment of the face of the fixed jaw is toothed and the other segment of this face is flat which can prevent the sharp corners of the hex bolt or hex nut from being damaged when the gripped bolt or nut rotates with respect to the wrench. The movable jaw unit is movably arranged in the sliding slot provided in the head of the wrench body.

FIGS. 4 to 7 show the second embodiment of the invention, in which the same part as that in the first embodiment is indicated by same reference number as that in the first embodiment. According to the second embodiment, a clutch unit comprises a holder 5' with the worm 8, a shaft 9' of the worm 8 mounted on the holder 5', a pull plate 7' integrated with the holder 5' and a supporting spring (not shown) provided between the pull plate 7' and a long side of the rectangular hole. Guide grooves are formed in the two short sides of the rectangular hole and extend therealong. The two ends of the shaft 9' of the worm are put in the grooves. The holder 7' with the worm 8 is raised under the force of the supporting spring to a front position where the worm 8 engages with the gear rack 10 of the movable jaw, whereby the normal adjustment of the wrench opening can be carried out.

By drawing the pull plate 7' backward, the holder 5' with the worm 8 moves backward simultaneously while the supporting spring is compressed, so that the engagement of the worm 8 and the gear rack 10 is released, whereby the movable jaw unit can so freely slide along the sliding slot that it can be moved conveniently to quickly adjust the opening of the wrench and also that it can be removed from the sliding slot, reversed, and inserted back to carry out the alternate function of the wrench.

Moreover, according to the second embodiment of the invention the toothed element 11' is hinged at the movably jaw 2 by a pin 15' provided at the lower portion of the opposed toothed side thereof.

Figure 6A:
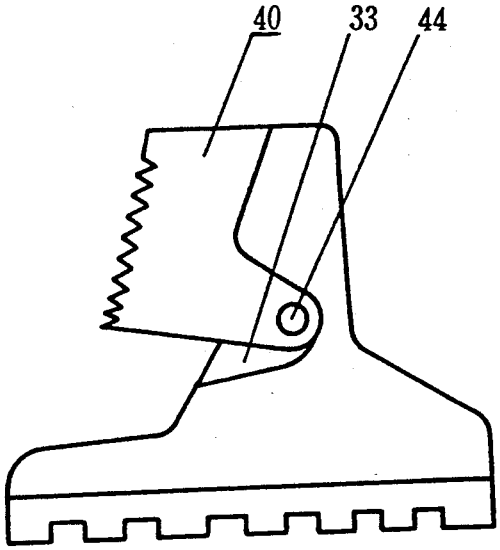
FIG. 6A is a schematic sectional view of the movable jaw unit.
Figure 6B:
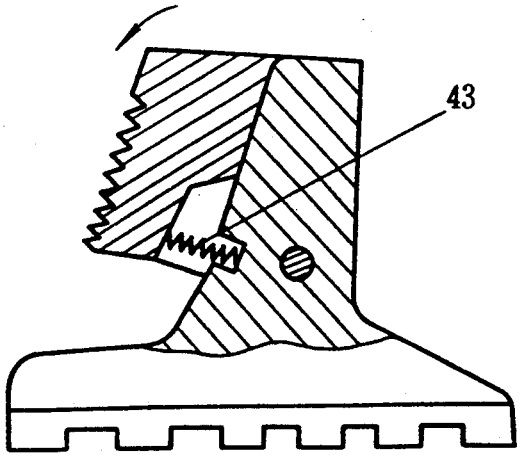
FIG. 6B is a schematic partial side view of the movable jaw unit.
Figure 7A:
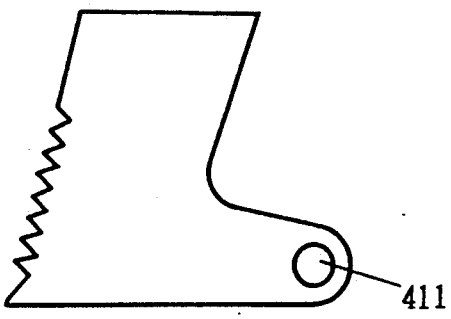
FIG. 7A is a schematic elevation view of the toothed element.
Figure 7B:
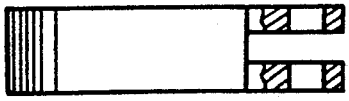
FIG. 7B is a schematic top view of the toothed element.

FIG. 6A and 6B further show a structure of the movable jaw unit, in which reference number 16 indicates a positioning groove and, the toothed L-shaped element 11' is hinged by the pin 15' provided at the offset position of the toothed element and is supported by a supporting spring 12'. It also can be seen from FIGS. 7A and 7B that the pin hole of the toothed element 11' is formed at the offset position of the toothed element.

The wrench with a clutch unit provided by the present invention has advantages of quick adjusting the wrench opening and of conveniently alternating two functions as a normal adjustable wrench to deal with the bolt connection and as a pipe wrench to deal with a pipe thread connection. The FIGS. 4 and 5 show the operation of the two functions of the wrench of the invention, in which reference number 13 indicates a bolt workpiece and number 13' indicates a pipe workpiece.

What is claimed is:

1. A dual-purpose adjustable wrench comprising:

a wrench body having an integrally formed fixed jaw at a first end extending outwardly from said wrench body, said wrench body having a rectangular aperture extending through said body, said aperture having a pair of opposing longitudinal side walls, each side wall having a groove extending from a surface of said wrench body, said wrench body further having a slot transverse to said rectangular aperture;

a movable jaw slidable and reversibly received in said transverse slot of the wrench body, said movable jaw including a flat first lateral side and a second lateral opposite side for cooperating with said longitudinal face of said fixed jaw, and a gear rack on a lower side of said movable jaw and being slidably received in said transverse slot;

a clutch means pivotally mounted in said rectangular aperture, said clutch means comprising a holder, a worm gear rotatably mounted on a worm gear shaft, said worm gear shaft mounted in said holder and having first and second rectangular ends, each end extending from said holder and being removably received in said grooves in the side walls of the aperture, a push plate integral with said holder, and a pivot pin mounted in said rectangular aperture and pivotally supporting said holder to pivot said worm gear from a first position engaging said gear rack to a second position disengaging said gear rack whereby said movable jaw can slide freely in said transverse slot and be removed from said wrench body;

a toothed element having a first end and second end and a longitudinal outwardly facing toothed lateral side, a pivot pin pivotally connecting said first end to said movable jaw, and a spring received in a blind hole in said toothed element to spring bias said second end of said toothed element away from said movable jaw.

* * * * *